US010293462B2

(12) United States Patent
Ting

(10) Patent No.: US 10,293,462 B2
(45) Date of Patent: May 21, 2019

(54) PAD CONDITIONER AND METHOD OF RECONDITIONING PLANARIZATION PAD

(71) Applicant: TAIWAN SEMICONDUCTOR MANUFACTURING COMPANY, LTD., Hsinchu (TW)

(72) Inventor: Hui-Wen Ting, Hsinchu (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 659 days.

(21) Appl. No.: 13/948,799

(22) Filed: Jul. 23, 2013

(65) Prior Publication Data

US 2015/0031273 A1 Jan. 29, 2015

(51) Int. Cl.
*B24B 37/04* (2012.01)
*B24B 53/017* (2012.01)

(52) U.S. Cl.
CPC ..... *B24B 53/017* (2013.01); *B24B 37/042* (2013.01)

(58) Field of Classification Search
CPC ..... B24B 53/017; B24B 37/04; B24B 53/02; B24B 53/095
USPC ..... 451/56, 72, 259, 443, 444
See application file for complete search history.

(56) References Cited

U.S. PATENT DOCUMENTS 5,445,996 A * 8/1995 Kodera ..... B24B 37/013 257/E21.243
5,876,508 A * 3/1999 Wu ..... B08B 3/02 134/2
6,086,454 A * 7/2000 Watanabe ..... B24B 37/04 451/36
6,302,771 B1 * 10/2001 Liu et al. ..... 451/56
6,645,053 B1 * 11/2003 Kimura et al. ..... 451/56
7,014,552 B1 * 3/2006 Collier et al. ..... 452/56
7,153,191 B2 * 12/2006 Naik ..... B24B 53/017 451/287
7,455,575 B2 * 11/2008 Kim ..... B24B 53/017 451/41
2002/0039880 A1 * 4/2002 Torii et al. ..... 451/446
2003/0060130 A1 * 3/2003 Kramer ..... B24B 53/013 451/20
2003/0153252 A1 * 8/2003 Cron ..... 451/56
2003/0199229 A1 * 10/2003 Vereen ..... B24B 57/02 451/36
2004/0038632 A1 * 2/2004 Cheng ..... B24B 53/017 451/287
2005/0164613 A1 * 7/2005 Seike ..... B24B 53/017 451/56
2006/0073773 A1 * 4/2006 Exley ..... B24B 53/017 451/56
2007/0298692 A1 * 12/2007 Mavliev ..... B24B 53/017 451/56
2008/0070488 A1 * 3/2008 Fujita ..... 451/444
2009/0301518 A1 * 12/2009 Oikawa ..... B08B 3/02 134/1.3

* cited by examiner

*Primary Examiner* — Monica S Carter
*Assistant Examiner* — Marcel T Dion
(74) *Attorney, Agent, or Firm* — Hauptman Ham, LLP

(57) ABSTRACT

A planarization device includes a planarization pad and a pad conditioner over the planarization pad. The pad conditioner includes a rotatable plate having a lower surface separated from an upper surface of the planarization pad by a predetermined distance and at least one nozzle opening on the lower surface of the rotatable plate.

19 Claims, 4 Drawing Sheets

PAD CONDITIONER AND METHOD OF RECONDITIONING PLANARIZATION PAD

BACKGROUND

Technological advances in integrated circuit (IC) materials and design have produced generations of ICs where each generation has smaller and more complex circuits than the previous generation. However, these advances have increased the complexity of processing and manufacturing ICs and, for these advances to be realized, similar developments in IC processing and manufacturing are needed. For example, planarization technology, such as a chemical mechanical polishing (CMP) process, has been implemented to planarize a substrate or one or more layers of features over the substrate. A material removal rate for a CMP process varies according to various factors, including roughness of an upper surface of a planarization pad in a planarization device where the CMP process takes place.

DESCRIPTION OF THE DRAWINGS

One or more embodiments are illustrated by way of example, and not by limitation, in the figures of the accompanying drawings, wherein elements having the same reference numeral designations represent like elements throughout.

DETAILED DESCRIPTION

Figure 1:
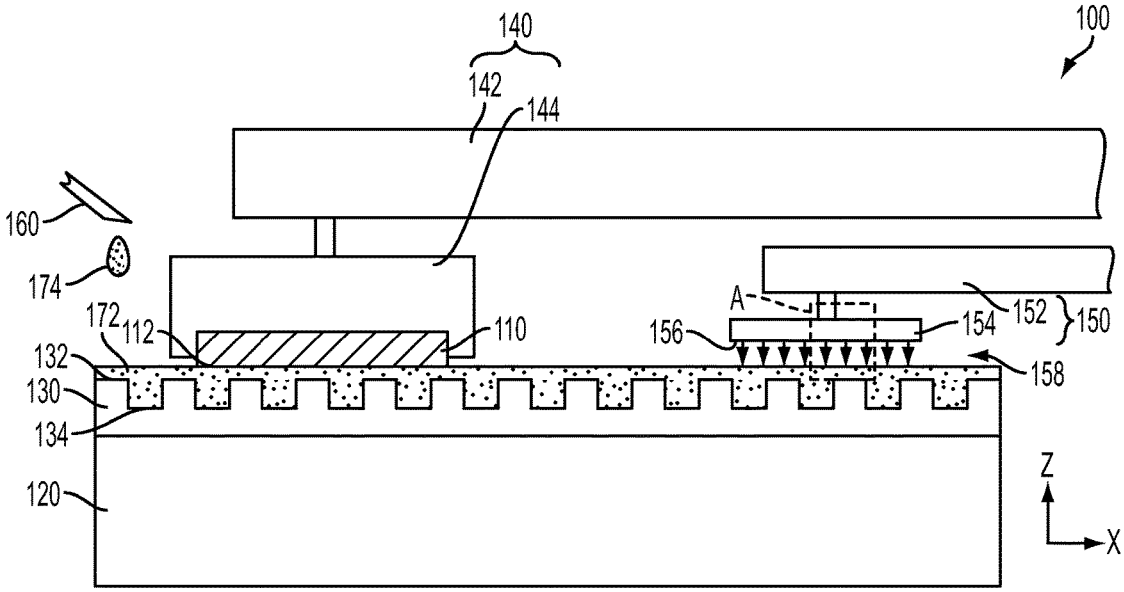
FIG. 1 is a cross-sectional view of a portion of a planarization device having a semiconductor wafer therewithin in accordance with one or more embodiments.

It is understood that the following disclosure provides one or more different embodiments, or examples, for implementing different features of the disclosure. Specific examples of components and arrangements are described below to simplify the present disclosure. These are, of course, examples and are not intended to be limiting. In accordance with the standard practice in the industry, various features in the drawings are not drawn to scale and are used for illustration purposes only.

Moreover, spatially relative terms, for example, "lower," "upper," "horizontal," "vertical," "above," "below," "up," "down," "top," "bottom," "left," "right," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

In accordance with the present application, in at least one embodiment, a pressurized fluid material is dispensed onto a planarization pad of a planarization device for maintaining the roughness of the planarization pad and for removing residues on the planarization pad, which are sometimes collectively referred to as reconditioning the planarization pad. Compared with another configuration using diamond plate for reconditioning, using pressurized fluid material reduces the scratch defects on a CMP-processed wafer caused by cracked diamonds.

FIG. 1 is a cross-sectional view of a portion of a planarization device 100 having a semiconductor wafer 110 therewithin in accordance with one or more embodiments. Planarization device 100 includes a platform 120, a planarization pad 130 over platform 120, a wafer holder 140 over platform 120 and holding wafer 110, a pad conditioner 150 over planarization pad 130, and a slurry dispenser 160 over platform 120. Planarization pad 130 has an upper surface 132 and grooves 134, and the grooves 134 have bottom surfaces lower than the upper surface 132. The upper surface 132 of the planarization pad 130 defines a reference plane in parallel with X direction and Y direction (a direction into the page, not shown). In some embodiments, the wafer 110 is a semiconductor wafer having a surface 112 to be processed by a planarization process. During a period that planarization device 100 is operated to perform a planarization process, such as a CMP process, a layer of slurry material 172 is over the planarization pad 130, filling the grooves 134, and in contact with upper surface 132 of planarization pad 130 and surface 112 of wafer 110.

Wafer holder 140 includes a robot arm 142 and a clamper 144 rotatably mounted to the robot arm. In some embodiments, robot arm 142 includes a driving unit configured to move clamper 144 along a direction parallel to the upper surface 132 of planarization pad 130. In some embodiments, robot arm 142 and/or clamper 144 include a driving unit configured to cause clamper 144 to rotate according to a first predetermined rotational-speed profile. In some embodiments, the first predetermined rotational-speed profile includes a rotational speed ranging from 0 to 200 revolutions per minute (rpm).

Pad conditioner 150 includes a robot arm 152 and a plate 154 rotatably mounted to the robot arm. In some embodiments, robot arm 152 includes a driving unit configured to move plate 154 along a direction parallel to the upper surface 132 of planarization pad 130. In some embodiments, robot arm 152 and/or clamper 154 include a driving unit configured to cause plate 154 to rotate according to a second predetermined rotational-speed profile. In some embodiments, the second predetermined rotational-speed profile includes a rotational speed ranging from 40 rpm to 300 rpm. In at least one embodiment, the platform 120 is also rotatable.

Slurry dispenser 160 delivers a slurry material 174 onto upper surface 132 of the planarization pad 130 to form the layer of slurry material 172. In some embodiments, the layer of slurry material 172 includes a solution containing etchant and/or polishing grit.

During operation of the planarization device 100, the wafer holder 140 and the planarization pad 130 are movable with respect to each other. The layer of slurry material 172 chemically etching and mechanically abrading the surface 112 of the wafer 110 in order to planarize (also being referred to as "polish") the surface 112 of the wafer 110 at a predetermined removal rate.

In some embodiments, the upper surface 132 of the planarization pad 130 is prepared to have a predetermined range of roughness. However, during operation of the planarization device 100, the upper surface 132 of the planarization pad 130 becomes smoother. In order to keep the roughness of the upper surface 132 within the predetermined range, pad conditioner 150 is usable to scratch the upper surface 132 of the planarization pad 130 in order to maintain the roughness of the upper surface 132 and to remove any residues formed on the upper surface 132.

The plate 154 of pad conditioner 150 has a lower surface 156 separated from upper surface 132 of the planarization pad 130 by a predetermined distance D (FIG. 2) and one or more nozzle openings on the lower surface 156 of the plate 154. A fluid material 158 is dispensed onto upper surface 132 of the planarization pad 130 through the one or more nozzle openings in order to recondition the planarization pad. In some embodiments, the reconditioning of the upper surface 132 of the planarization pad 130 is performed during the polishing of the surface 112 of the wafer 110 or before or after the polishing of the surface 112.

Figure 2:
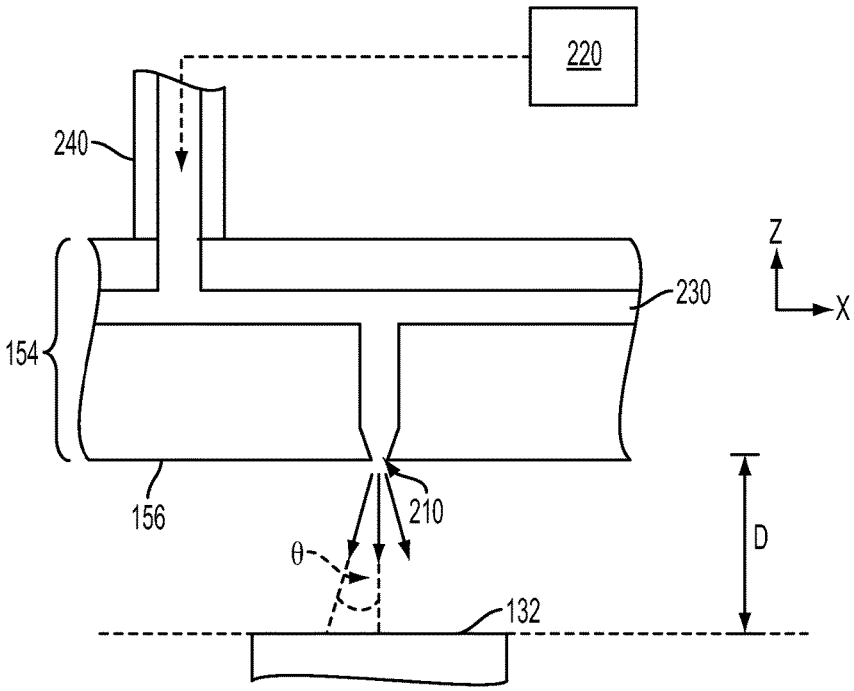
FIG. 2 is an enlarged view of region A in FIG. 1 in accordance with one or more embodiments.

FIG. 2 is an enlarged view of region A in FIG. 1 in accordance with one or more embodiments. One or more nozzle openings 210 are disposed on a lower surface of plate 154. The lower surface 156 of the plate 154 and the upper surface 132 of the planarization pad 130 are separated by a predetermined distance D. In some embodiments, the predetermined distance D ranges from 0.1 to 250 millimeters (mm).

A fluid dispensing unit 220 is coupled with the one or more nozzle openings 210 through a conduit system 230. In some embodiments, conduit system 230 includes a network of tubes passing though the robot arm 152, a rotational axel 240 connecting the plate 154 and robot arm 152, and/or embedded inside the plate 154. Fluid dispensing unit 220 is configured to dispense the fluid material 158 onto the upper surface 132 of the planarization pad 130 through the one or more nozzle openings 210. In some embodiments, fluid dispensing unit 220 is mounted on the robot arm 152. In some embodiments, fluid dispensing unit 220 is disposed separately from the robot arm 152.

In some embodiments, fluid dispensing unit 220 is configured to dispense the fluid material 158 at a predetermined spray pressure at the one or more nozzle openings 210. In some embodiments, the predetermined pressure is set to be sufficient to remove residues on the planarization pad 130. In some embodiments, the predetermined pressure is set to be sufficient to restore the roughness of the upper surface 132 of the planarization pad 130.

In some embodiments, the predetermined spray pressure ranges from 0.1 pounds per square inch (PSI) to 20 PSI. In some embodiments, fluid dispensing unit 220 and the one or more nozzle openings are configured to dispense the fluid material 158 at a predetermined spray angle θ at one of the one or more nozzle openings, and the predetermined spray angle θ ranges from 0 degree to 45 degrees with respect to Z direction, which is perpendicular to the upper surface 132 of the planarization pad. A non-zero degree spray angle helps to wash residues out of the grooves 134 and restore the roughness of the upper surface 132. In some embodiments, the reconditioning of planarization pad 130 is primarily based on a downward (i.e., along the negative Z direction) force to "grind" the upper surface 132 by pressurized fluid material. Thus, if the spray angle is greater than 45 degrees, the reconditioning of planarization pad 130 would be less power-efficient.

In some embodiments, the fluid material 158 includes a slurry material when the fluid dispensing unit 220 is operated during a planarization process performed by the planarization device 100 (FIG. 1). In some embodiments, the fluid material 158 includes water, de-ionized water, $NH_4OH$ based solution, HF based solution, KOH based solution, or citric acid based solution, silica based solution, cerium based solution, or hydrous solution having a water weight percentage greater than 20%, when the fluid dispensing unit 220 is operated before or after a planarization process performed by the planarization device 100.

Various patterns of nozzle openings are illustrated in conjunction with FIGS. 3A-3H.

Figure 3A:
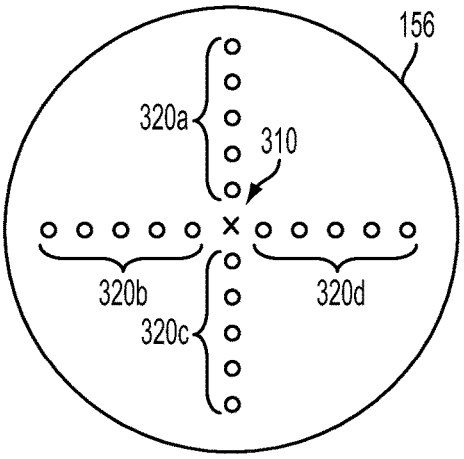
FIGS. 3A-3H are diagrams of various patterns of nozzle openings in accordance with one or more embodiments.

FIG. 3A is a diagram of a first example pattern of nozzle openings **320*a*-320*d* in accordance with one or more embodiments. Nozzle openings 320*a*-320*d* are on the lower surface 156 of the plate and arranged in a radially symmetrical manner about a rotational center 310 of the rotatable plate. In the example depicted in FIG. 3A, nozzle openings 320*a* and 320*c* are positioned along a line crossing the rotational center 310, and nozzle openings 320*b* and 320*d* are positioned along another line crossing the rotational center 310**.

Figure 3B:
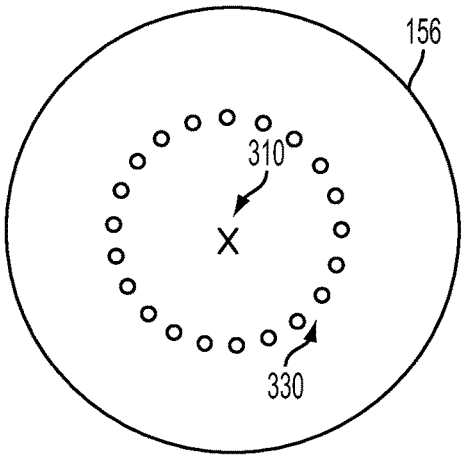

FIG. 3B is a diagram of a second example pattern of nozzle openings 330 in accordance with one or more embodiments. Nozzle openings 330 are on the lower surface 156 of the plate and arranged in a circularly symmetrical manner about the rotational center 310 of the rotatable plate. In the example depicted in FIG. 3B, nozzle openings 330 are positioned along a peripheral of a circle having a center coinciding with the rotational center 310.

Figure 3C:
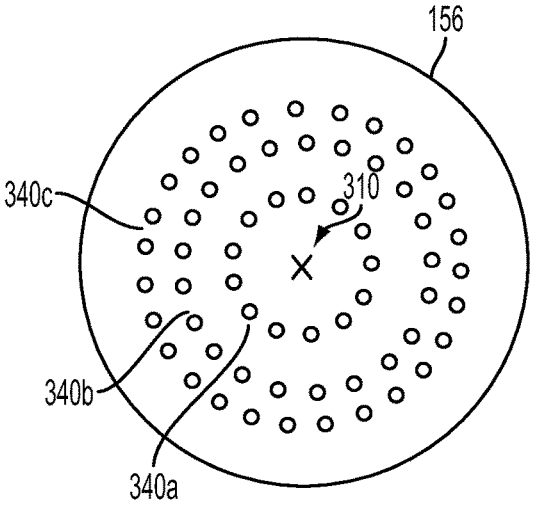

FIG. 3C is a diagram of a third example pattern of nozzle openings **340*a*-340*c* in accordance with one or more embodiments. Nozzle openings 340*a*-340*c* are on the lower surface 156 of the plate and arranged in a circularly symmetrical manner about the rotational center 310 of the rotatable plate. In the example depicted in FIG. 3C, nozzle openings 340*a*, 340*b*, and 340*c* are positioned along peripherals of corresponding circles having centers coinciding with the rotational center 310. In other words, nozzle openings 340*a*, 340*b*, and 340*c* are positioned along peripherals of concentric circles about the rotational center 310**.

Figure 3D:
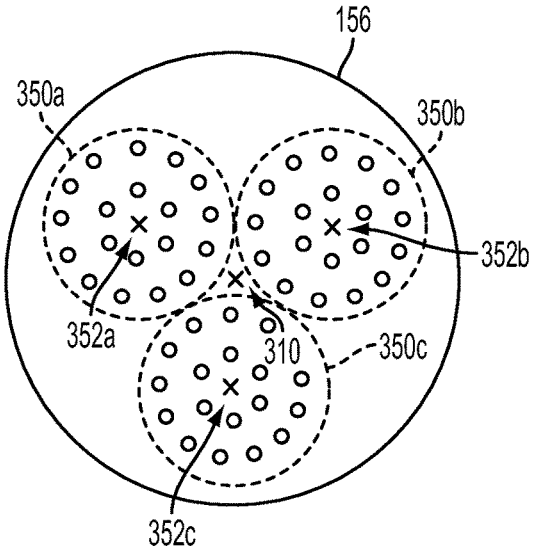

FIG. 3D is a diagram of a fourth example pattern of nozzle openings **350*a*-350*c* in accordance with one or more embodiments. Nozzle openings 350*a*-350*c* are on the lower surface 156 of the plate. Nozzle openings 350*a* have a geographic center 352*a*, nozzle openings 350*b* have a geographic center 352*b*, and nozzle openings 350*c* have a geographic center 352*c*. The geographic centers 352*a*-352*c* of nozzle openings 350*a*-350*c* are arranged in a radially symmetrical manner or a circularly symmetrical manner about the rotational center 310** of the plate.

Figure 3E:
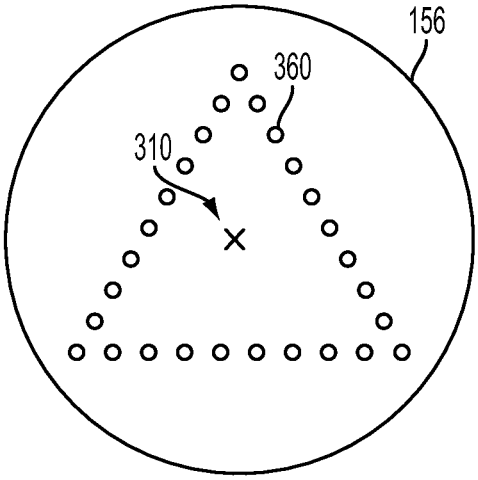
Figure 3F:
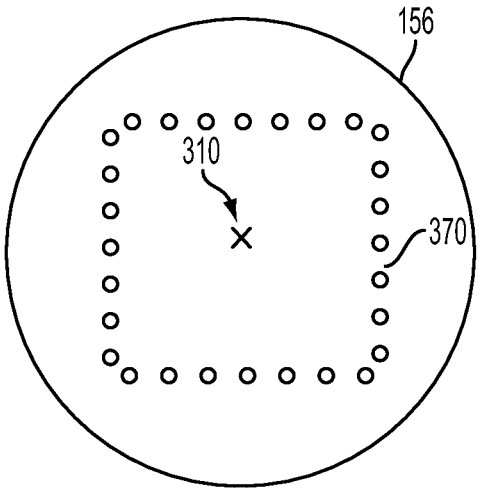
Figure 3G:
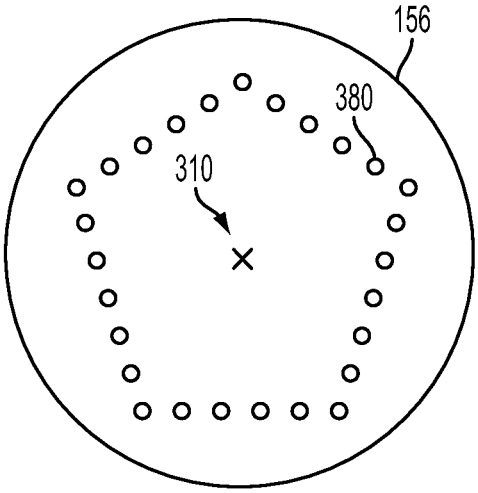

FIGS. 3E-3G are diagrams of additional example patterns of nozzle openings 360, 370, and 380 in accordance with one or more embodiments. Nozzle openings 360, 370, and 380 are on the lower surface 156 of the plate and positioned along at least one polygon, such as a triangle (360), a square or rectangle (370), a pentagon (380), or an ellipse (not shown), or any other suitable shapes. Although only one polygon is depicted in FIG. 3E, 3F, or 3G, in some embodiments, nozzle openings are arranged according to one or more of the same polygon of a different size or different polygons, circles, or ellipses of various sizes.

Figure 3H:
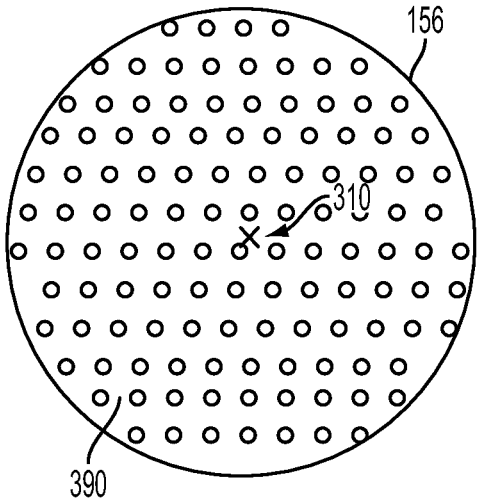

FIG. 3H is a diagram of yet another example pattern of nozzle openings 390 in accordance with one or more embodiments. Nozzle openings 390 are on the lower surface 156 of the plate and evenly distributed on the lower surface of the plate. In at least one embodiment, nozzle openings 390 are randomly distributed on the lower surface 156 of the plate.

The patterns of nozzle openings depicted in FIGS. 3A-3H are merely examples. In some embodiments, nozzle openings are positioned according to other suitable patterns. In some embodiments, nozzle openings have a geographic center substantially coinciding with the rotational center of the plate.

Figure 4:
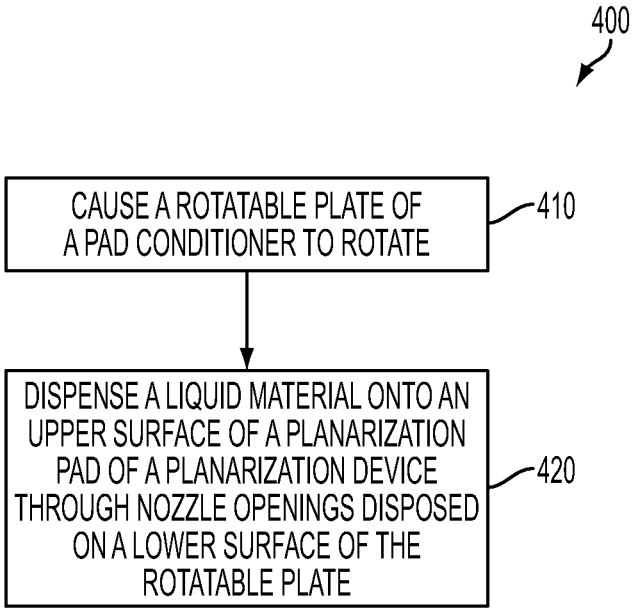
FIG. 4 is a flow chart of a method of reconditioning a planarization pad in accordance with one or more embodiments.

FIG. 4 is a flow chart of a method 400 of reconditioning a planarization pad in accordance with one or more embodiments. It is understood that additional operations may be performed before, during, and/or after the method 400 depicted in FIG. 8, and that some other processes may only be briefly described herein.

As depicted in FIG. 4 and FIG. 1, in operation 410, a driving unit causes a plate 154 of a pad conditioner 150 to rotate according to a predetermined rotational-speed profile. In some embodiments, the predetermined rotational-speed profile includes a rotational speed ranging from 40 rpm to 300 rpm.

As depicted in FIG. 4 and FIGS. 1-2, in operation 420, a fluid dispensing unit 220 dispenses a fluid material 158 onto an upper surface 132 of a planarization pad 150 of a planarization device 100 through nozzle openings 210 disposed on a lower surface 156 of the plate 154. In some embodiments, the dispensing the fluid material includes dispensing the fluid material 158 at a predetermined spray pressure at the nozzle openings 210. In some embodiments, the predetermined spray pressure ranges from 0.1 PSI to 20 PSI. In some embodiments, the dispensing the fluid material includes dispensing the fluid material 158 at a predetermined spray angle θ at the nozzle openings 210. In some embodiments, the predetermined spray angle θ ranges from 0 degree to 45 degrees with respect to Z direction, which is perpendicular to the upper surface 132 of the planarization pad 130.

In some embodiments, the dispensing the fluid material further includes dispensing a slurry material during a period the planarization pad 130 is operated to perform a planarization process. In some embodiments, the dispensing the fluid material further includes dispensing water, de-ionized water, $NH_4OH$ based solution, HF based solution, KOH based solution, or citric acid based solution, silica based solution, cerium based solution, or hydrous solution having a water weight percentage greater than 20%, during a period before or after the planarization pad 130 is operated to perform a planarization process.

In accordance with one embodiment, a planarization device includes a planarization pad and a pad conditioner over the planarization pad. The pad conditioner includes a rotatable plate having a lower surface separated from an upper surface of the planarization pad by a predetermined distance and at least one nozzle opening on the lower surface of the rotatable plate.

In accordance with another embodiment, a manufacture including a plate, a driving unit, and a plurality of nozzle openings. The plate has a rotational center and a lower surface, and the plate is rotatable about the rotational center. The driving unit is configured to cause the rotatable plate to rotate according to a predetermined rotation-speed profile. The plurality of nozzle openings is on the lower surface of the rotatable plate.

In accordance with another embodiment, a method includes causing a rotatable plate of a pad conditioner to rotate. A fluid material is dispensed onto an upper surface of a planarization pad of a planarization device through nozzle openings disposed on a lower surface of the rotatable plate.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A planarization device, comprising:

a planarization pad; and a pad conditioner over the planarization pad, the pad conditioner comprising:

a rotatable plate having a lower surface separated from an upper surface of the planarization pad by a predetermined distance;

at least one nozzle opening on the lower surface of the rotatable plate; and a fluid dispensing unit configured to selectively dispense a fluid material onto the upper surface of the planarization pad through the at least one nozzle opening based on an operating mode of the planarization device, wherein the fluid material comprises an acid when the fluid dispensing unit is operated before or after a planarization process performed by the planarization device, the lower surface of the rotatable plate is a closest surface of the pad conditioner to the upper surface of the planarization pad, and the pad conditioner is configured to maintain at least the predetermined distance between the lower surface of the rotatable plate and the upper surface of the planarization pad when in use.

2. The planarization device of claim 1, wherein the pad conditioner further comprises:

a driving unit configured to cause the rotatable plate to rotate.

3. The planarization device of claim 2, wherein the driving unit is configured to cause the rotatable plate to rotate at a rotational speed ranging from 40 revolutions per minute (rpm) to 300 rpm.

4. The planarization device of claim 1, wherein the pad conditioner further comprises:

a driving unit configured to cause the rotatable plate to move along a direction parallel to the upper surface of the planarization pad.

5. The planarization device of claim 1, wherein the fluid dispensing unit is configured to dispense the fluid material at a predetermined spray pressure at the at least one nozzle opening, and the predetermined spray pressure ranges from 0.1 pounds per square inch (PSI) to 20 PSI.

6. The planarization device of claim 1, wherein the fluid dispensing unit and the at least one nozzle opening are configured to dispense the fluid material at a predetermined spray angle at the at least one nozzle opening, and the predetermined spray angle ranges from 0 degree to 45 degrees with respect to a direction perpendicular to the upper surface of the planarization pad.

7. The planarization device of claim 1, wherein the fluid material comprises a slurry material when the fluid dispensing unit is operated during the planarization process performed by the planarization device.

8. The planarization device of claim 1, wherein the fluid material further comprises one or more of water, de-ionized water, $NH_4OH$ based solution, KOH based solution, silica based solution, cerium based solution, or hydrous solution having a water weight percentage greater than 20%, when the fluid dispensing unit is operated before or after the planarization process performed by the planarization device, and the acid comprises at least one of an HF based solution or a citric acid based solution.

9. The planarization device of claim 1, wherein the at least one nozzle opening comprises a plurality of nozzle openings, and the plurality of nozzle openings is evenly distributed on the lower surface of the rotatable plate.

10. The planarization device of claim 1, wherein the at least one nozzle opening comprises a plurality of nozzle openings on the lower surface of the rotatable plate, and the plurality of nozzle openings has a geographic center substantially coinciding with a rotational center of the rotatable plate.

11. The planarization device of claim 10, wherein the plurality of nozzle openings is positioned along a peripheral of at least one circle, ellipse, or polygon.

12. The planarization device of claim 1, wherein the at least one nozzle opening comprises a plurality of nozzle openings on the lower surface of the rotatable plate, and the plurality of nozzle openings is arranged in a radially symmetrical manner or a circularly symmetrical manner about a rotational center of the rotatable plate.

13. The planarization device of claim 12, wherein the plurality of nozzle openings is arranged along one or more concentric circles about the rotational center of the rotatable plate.

14. The planarization device of claim 1, wherein the at least one nozzle opening comprises a plurality of nozzle openings on the lower surface of the rotatable plate, the plurality of nozzle openings is grouped into two or more sets of nozzle openings, each set of the sets of nozzle openings has a geographic center, and the geographic centers of the sets of nozzle openings are arranged in a radially symmetrical manner or a circularly symmetrical manner about a rotational center of the rotatable plate.

15. An apparatus, comprising:

a planarization pad;

a wafer holder for supporting a wafer during a planarization process; and a pad conditioner over the planarization pad, wherein the pad conditioner is separate from the wafer holder, and the pad conditioner comprising:

a plate having a rotational center and a lower surface, the plate being rotatable about the rotational center and separated from an upper surface of the planarization pad by a predetermined distance;

a driving unit configured to cause the rotatable plate to rotate according to a predetermined rotation-speed profile;

a plurality of nozzle openings on the lower surface of the rotatable plate; and a fluid dispensing unit configured to selectively dispense a fluid material onto the upper surface of the planarization pad through at least one of the plurality of nozzle openings based on an operating mode of the planarization device, wherein the fluid material comprises an acid when the fluid dispensing unit is operated before or after a planarization process performed by the planarization device, the lower surface of the pad conditioner is a closest surface of the pad conditioner to the upper surface of the planarization pad, and the pad conditioner is configured to operate touchlessly with respect to the upper surface of the planarization pad.

16. The apparatus of claim 15, wherein the plurality of nozzle openings is evenly positioned on the lower surface of the rotatable plate.

17. The apparatus of claim 15, wherein the plurality of nozzle openings has a geographic center substantially coinciding with the rotational center of the rotatable plate.

18. The apparatus of claim 17, wherein the plurality of nozzle openings is positioned along a peripheral of at least one circle, ellipse, or polygon.

19. The apparatus of claim 15, wherein the plurality of nozzle openings is arranged in a radially symmetrical manner or a circularly symmetric manner about the rotational center of the rotatable plate.

* * * * *